US007859470B2

(12) United States Patent
Johnson

(10) Patent No.: US 7,859,470 B2
(45) Date of Patent: Dec. 28, 2010

(54) MULTIPLE ELEMENT ANTENNA ASSEMBLY

(75) Inventor: Greg F. Johnson, Aptos, CA (US)

(73) Assignee: Aerius International, Ltd., Lewes, DE (US)

( * ) Notice: Subject to any disclaimer, the term of this patent is extended or adjusted under 35 U.S.C. 154(b) by 196 days.

(21) Appl. No.: 12/199,474

(22) Filed: Aug. 27, 2008

(65) Prior Publication Data

US 2009/0085814 A1 Apr. 2, 2009

Related U.S. Application Data

(60) Provisional application No. 60/968,175, filed on Aug. 27, 2007.

(51) Int. Cl.
*H01Q 1/38* (2006.01)

(52) U.S. Cl. ..... 343/702; 343/725; 343/846

(58) Field of Classification Search ..... 343/700 MS, 343/702, 725, 846, 848
See application file for complete search history.

(56) References Cited

U.S. PATENT DOCUMENTS 5,771,022 A 6/1998 Vaughan et al.
6,222,496 B1 4/2001 Liu
6,295,030 B1 9/2001 Kozakai et al.
6,326,924 B1 12/2001 Muramoto et al.
6,337,670 B1 1/2002 Chen
6,339,402 B1 1/2002 McKivergan
6,768,460 B2 * 7/2004 Hoashi et al. ..... 343/700 MS
7,443,566 B2 * 10/2008 Lerenius et al. ..... 359/265

* cited by examiner

*Primary Examiner*—Hoang V Nguyen
(74) *Attorney, Agent, or Firm*—Briggs and Morgan, P.A.

(57) ABSTRACT

An antenna assembly for multiple band operation of a wireless communications devices such as cellphones. Embodiments of the present invention provides for operation over 824-960 MHz Cellphone and 1575 MHz GPS bands and 1710-2155 MHz. Coverage over the GPS frequency band is highly desirable for wireless communication devices such as cell phones, in order to provide location information. Radiating conducting elements can be positioned in close proximity to an inverted PIFA-type antenna, requiring very little additional space or volume and allowing nearly the same form factor to be used for the antenna assembly. An illuminated panel may be positioned within an aperture of the ground plane. The panel may be back lit and activated in response to an external signal.

19 Claims, 5 Drawing Sheets

FIG. 1
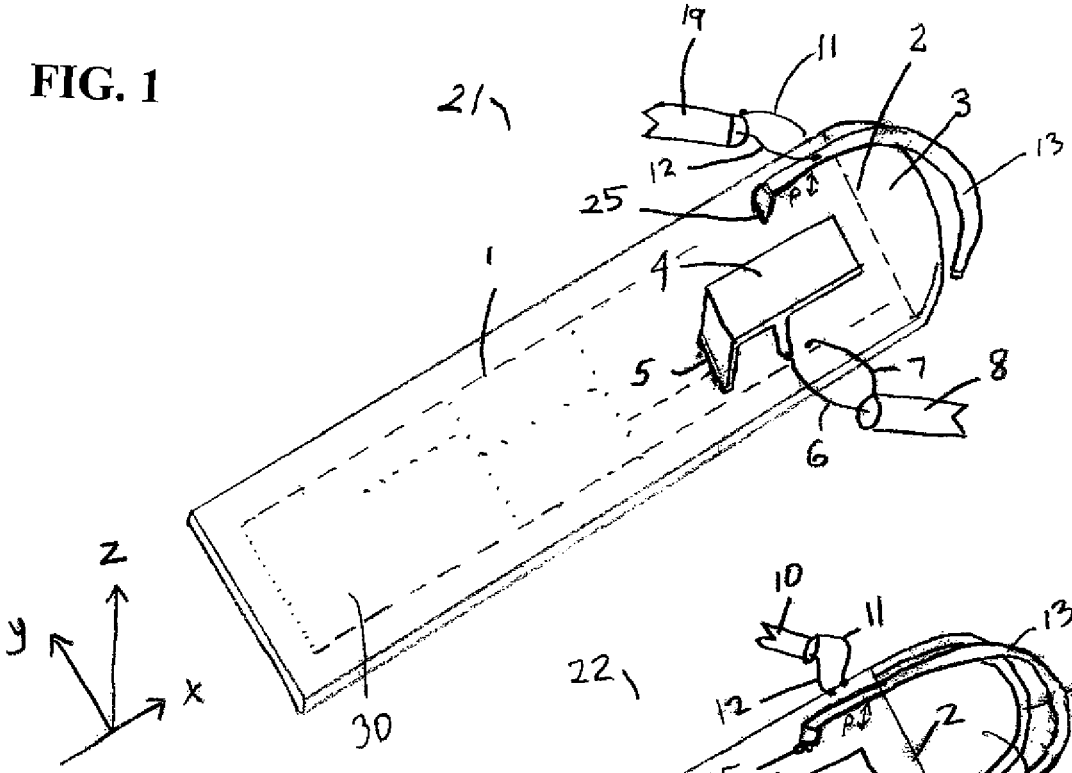
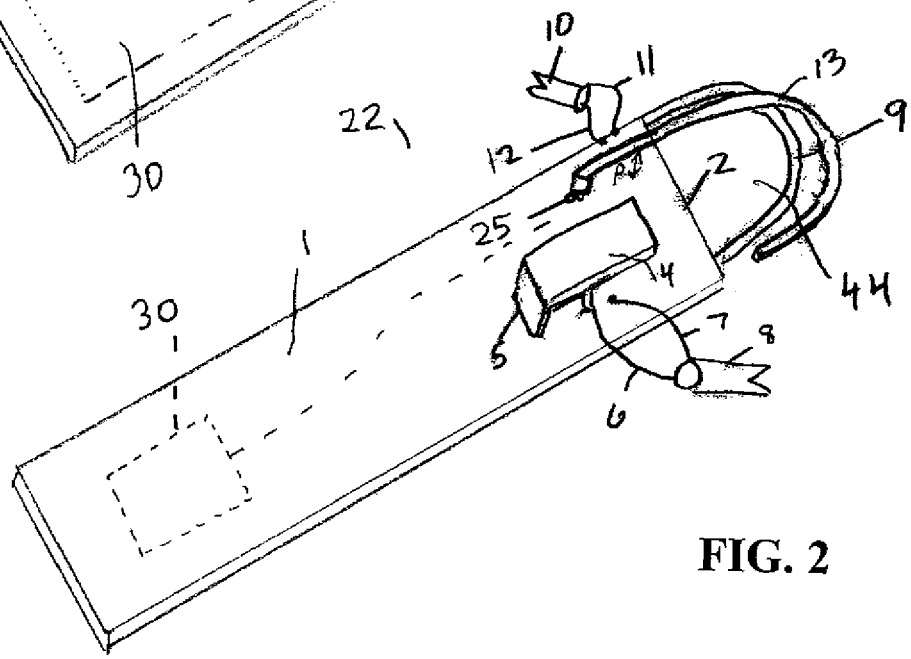
FIG. 2

FIG. 3
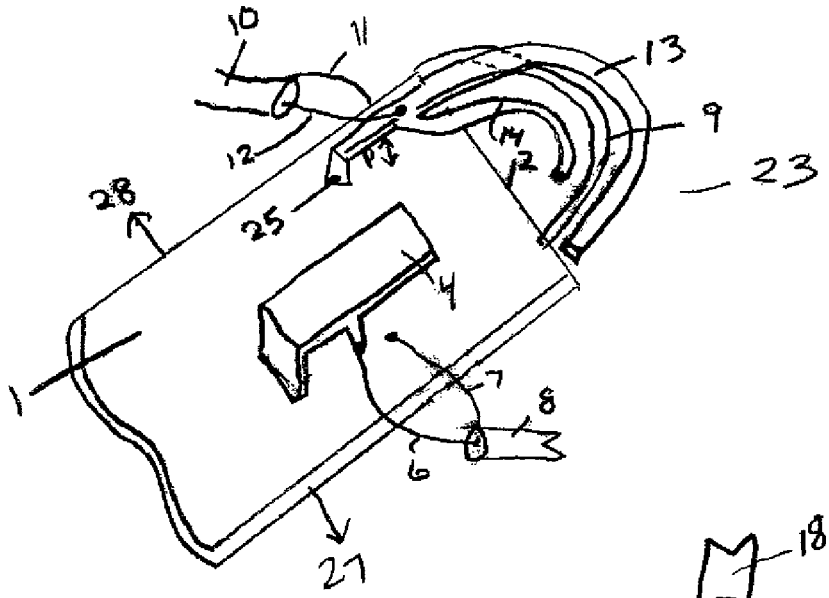
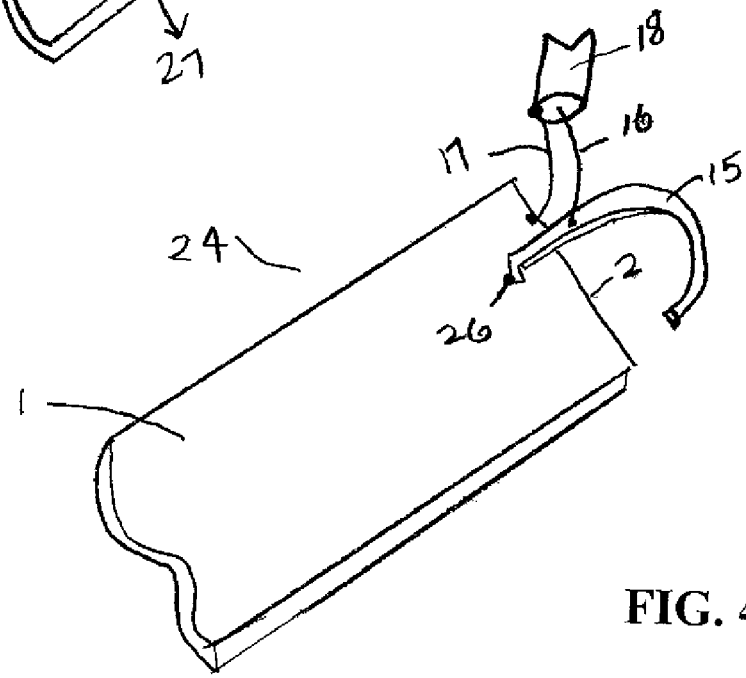
FIG. 4

MULTIPLE ELEMENT ANTENNA ASSEMBLY

RELATED APPLICATIONS

This application claims benefit of provisional Application No. 60/968,175, filed Aug. 27, 2007, and incorporated by reference herein.

TECHNICAL FIELD

The present invention relates to antenna assemblies for hand held radio frequency transmitters or receivers, and more particularly to antenna assemblies for communication devices such as cellular telephones.

BACKGROUND OF THE INVENTION

U.S. Pat. Nos. 6,639,564 and 7,230,574, incorporated by reference herein, disclose oriented PIFA antenna assemblies located near one end of a wireless communications device. Performance attributes include frequency coverage within 1710-1990 MHz, very low electromagnetic radiation directed into the users hand and head, providing low SAR or specific absorption rate, increased communication range, longer battery life, and reduction or elimination of noise in hearing aids.

One limitation of these antenna assemblies is the single band coverage. For many modern environments, multiple signal bands are available and it would be particularly desirable to have a wireless device capable of accessing and utilizing more than a single band of coverage during communication.

BRIEF SUMMARY OF THE INVENTION

To achieve the foregoing objects, and in accordance with the purpose of the invention as embodied and broadly described herein, a multiple element antenna assembly for a hand-held radio frequency communication device such as a cellular telephone is provided.

One object of the current invention is to retain all the advantages of the abovementioned prior art for the various communication bands within the 1710-2155 MHz frequency range, and to provide frequency coverage over 824-960 MHz cellular bands and the 1575 MHz GPS band.

An embodiment of the present invention includes an oriented PIFA and additional conducting elements to provide enhanced communication band coverage. An oriented PIFA may be used for communications bands in the 1710-2155 MHz frequency range. These bands are commonly used in cellphones manufactured for use for 3G or third generation cellphone networks.

Embodiment of the present invention include additional conducting elements which work in conjunction with the cellphone's printed circuit board (PCB) ground traces to provide frequency coverage for cellphone bands within 824-960 MHz, and the GPS band nominally centered around 1575 MHz. An embodiment of the present invention provides a complete antenna system for what is commonly referred to as a quad-band and 3G cellphone.

Another aspect of the present invention relates to an apertured ground plane assembly for a wireless communication device wherein one or more translucent or transparent panels are positioned within the aperture. In one embodiment, the panels may be backlight by a light source in response to a user action, such as turning the device ON or OFF, or in response to an external signal, such as reception of a call, etc.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

FIG. 1 is a depiction of a wireless communications device incorporating aspects of the present invention;

FIG. 2 is a depiction of another embodiment of a wireless communications device incorporating aspects of the present invention;

FIG. 3 is a depiction of yet another embodiment of a wireless communications device according to the present invention;

FIG. 4 is a partial depiction of another wireless communications device incorporating aspects of the present invention;

DETAILED DESCRIPTION OF THE INVENTION

Figure 7:
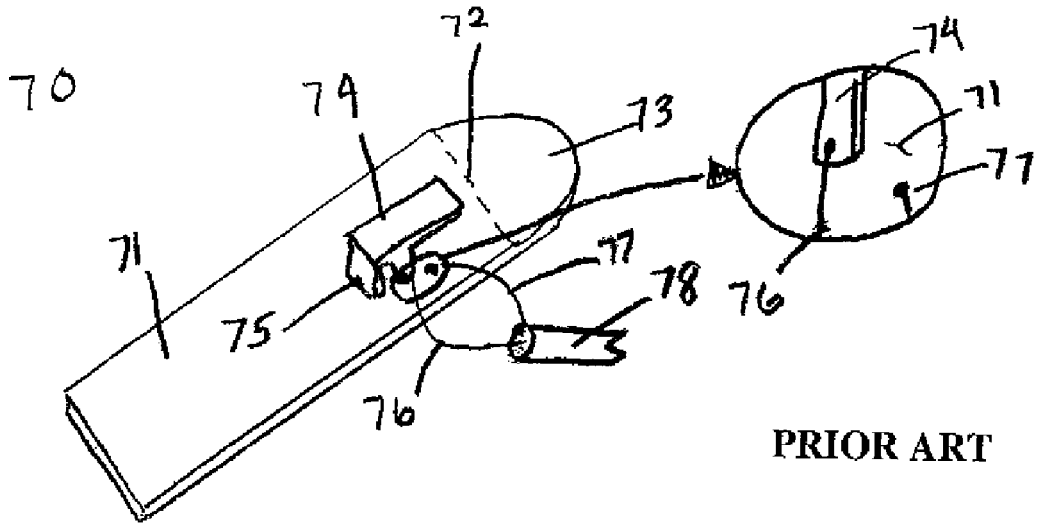
PRIOR ART FIG. 7
FIG. 7 is a depiction of a prior art antenna assembly for a wireless communications device.

By way of background, FIG. 7 illustrates a prior art antenna system 70 which includes an oriented PIFA element 74 coupled to ground plane 71 of a wireless communication device at location 75. The typical upper end of the wireless communications device's ground plane 71, that is where it would typically be located in art prior to the oriented PIFA 74, is shown by line 72. A ground plane extension 73 is included in the oriented PIFA antenna system 70. A low impedance feedpoint for the antenna is shown connected to a coax cable 78 by center conductor lead 76, which connects to the feed leg of PIFA element 74 which is isolated above ground plane 71. Lead 77 attaches to ground plane 71 adjacent to the feed leg of PIFA element 74.

Figure 8:
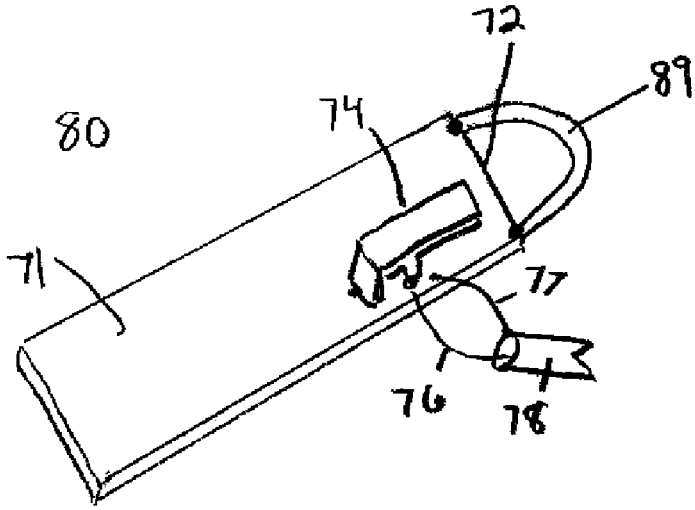
PRIOR ART FIG. 8
FIG. 8 is a depiction of a prior art antenna assembly for a wireless communications device.

Referring to FIG. 8, another version of a prior art antenna system 80 is shown. In this embodiment, a ground plane extension consists of a loop conductor 89 connected to ground plane 71 at both ends. Loop conductor 89 is generally coplanar with ground plane 71. Additional embodiments of prior art antenna systems are included in U.S. Pat. Nos. 6,639,564 and 7,230,574, incorporated by reference herein.

Referring to FIG. 1, numeral 21 generally depicts an embodiment of an antenna system of the present invention. An oriented PIFA element 4 is operational over 1710-2155 MHz, and additional fed conductor element 13 is provided for frequency coverage over another frequency range, such as 824-960 MHz. Conductor 13 is grounded to ground plane 1 at location 25. Conductor 13 is spaced away from ground plane 1 and ground extension 3 a distance "p" and includes a free end. Distance "p" is measured in the Z dimension as shown in FIG. 1. The length of conductor 13 can be adjusted for resonance over the desired frequency range. In one embodiment, dimension "p" is preferably from 0.1 to 0.5 inches, and more particularly 0.1875 inch for a conductor 13 extending 1.0 inch (in X dimension) away from edge 2. Conductor 13 is fed at a low impedance point by coax cable 10 via ground connection 11 and center conductor connection 12. Coax cable 10 may be replaced by a microstrip or other type of transmission line. Conductor 13 may be generally formed to be parallel to ground plane portion 3, and extend a preferred distance beyond the tip of element 3 by about 0.25 inches (in X dimension). Signal generating components 30 are provided upon ground plane element 1. As would be appreciated by one of ordinary skill in the art, signal generating components 30 included a variety of digital and/or analog components functioning to transmit, receive and process rf signals to and from PIFA element 4 and secondary conductor 13.

Referring to FIG. 2, another embodiment 22 of an antenna assembly of the present invention is shown. The ground plane extension portion 3 of FIG. 2 has been replaced with conductor loop 9. Again, conductor 13 may be closely spaced and parallel to loop 9, and extend a preferred minimum distance of 0.25 inches beyond upper edge of loop 9 (in X dimension). Aperture 44 is defined between conductor 13 and loop 9. Conductor 13 and loop 9 may be protected by a cover or shield to prevent damage while allowing light to pass through aperture 44. In another embodiment, a clear or translucent plastic panel can be located within aperture 44 and be backlit by a light source to provide desired aesthetics.

Referring to FIG. 3, another embodiment 23 of an antenna system of the present invention is shown. Conductor 14 has been added, attached to conductor 13 at a point at or near the coax center conductor 12 connection to element 13. Conductor 14 may extend in close proximity to conductor 13 and has a free end with a length adjusted for resonance at a desired frequency range, such as the 1575 MHz GPS band. Coax 10 carries both of the frequency bands resonated by conductor 13 and conductor 14. The antenna radiation pattern for conductor 14 is adjusted for the GPS band and preferably provides peaks in directions depicted by arrows 27, 28. This provides a distinct advantage when the wireless communications device is held to the user's head at a normal tilt angle of approximately 60 degrees off vertical because overhead GPS satellites can thereby be illuminated.

Referring to FIG. 4, a partial embodiment 24 of the antenna system of the present invention is shown. Here the conductor 15 is fed at a low impedance point by coax 18, thru center conductor lead 16 and ground lead 17. Conductor 15 is grounded to 1 at location 26. The length of conductor 15 may be adjusted for a desired frequency range, including the 1575 MHz GPS band. Another feed method may also be used, where conductor 15 is isolated from ground plane 1 and the coax ground lead is attached to edge 2 and the center conductor lead 16 is attached near one end of conductor 15.

Figure 5:
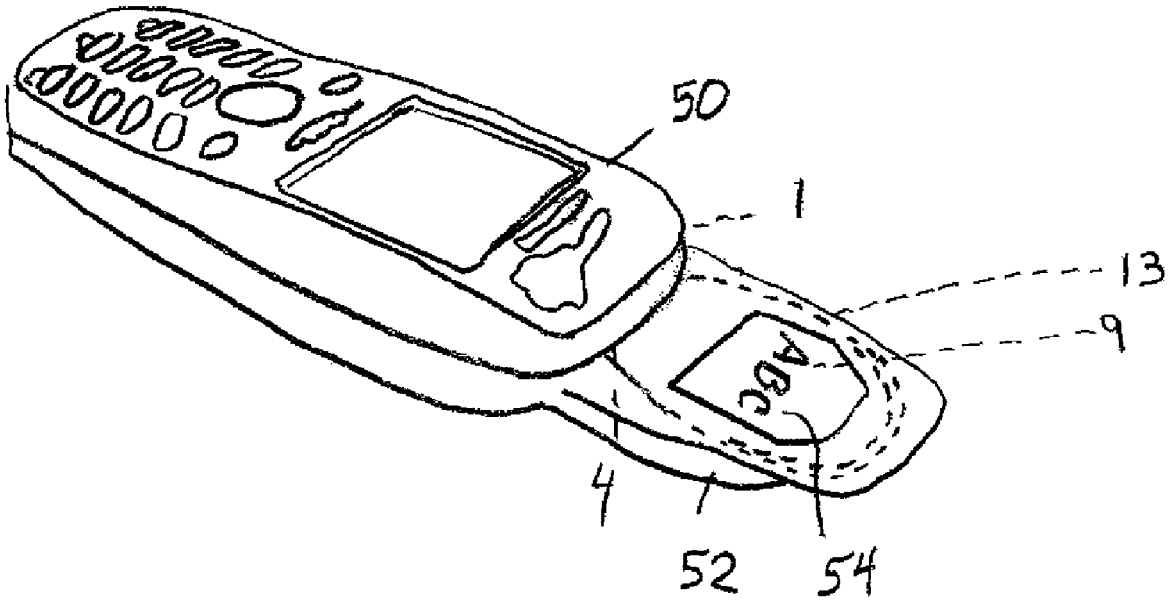
FIGS. 5 and 6 illustrate a wireless communications device incorporating aspects of the present invention.
Figure 6:
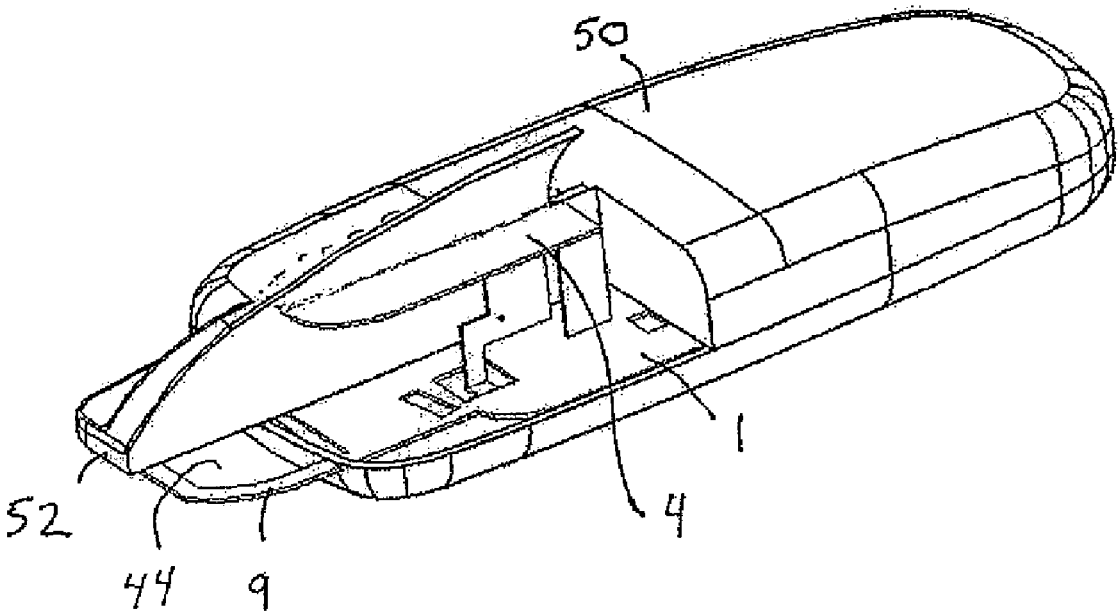

FIGS. 5 and 6 illustrate a wireless communications device 50 incorporating aspects of the present invention. FIG. 5 is a top perspective view of wireless communications device 50 and FIG. 6 is a bottom perspective view of wireless communications device 50, both figures showing a protective housing 52 extending above and around conductor loop 9. FIG. 6 is a partial cut-away view of wireless communications device 50 showing conductor loop 9.

Referring to FIG. 5, aperture 44 is defined within loop 9. Conductor loop (ground plane extension element) 9 is protected by cover 52 to prevent damage while allowing light to pass through aperture 44. One or more clear or translucent plastic panels 54 are located within aperture 44 and are backlit by a light source to provide desired aesthetics. Panels 54 may include indicia, such as etchings, markings, holograms, etc. that are differentially illuminated by an internal light source, such as an LED, to signal an operational mode to a user, e.g., ON state, ringing state, message received state, etc. Lighting of the indicia may be triggered by external signals, such as call receipt, message alert, low battery, etc. Operation and control of lights for illuminating the panels 54 may be provided on circuitry and/or software of the wireless communication device or remotely, for example, by a central station, etc.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna assembly for a wireless device comprising:

a conductive element having an upper edge and a lower edge defined between a middle portion, said conductive element being electrically coupled to a ground plane element of the wireless device;

a first driven conductor element coupled to the conductive element within the middle portion, said first driven conductor including a first element being generally perpendicular to the conductive element and a second element being generally parallel to the conductive element, said second element extending toward the upper edge of the wireless device; and a second driven conductor element coupled to the conductive element, said second driven conductor element including a first element being generally perpendicular to the conductive element and a second element being generally parallel to the conductive element, said second element extending toward the upper edge of the wireless device, and said second driven element being coupled to the conductive element at said first element, and said second driven element being driven via a feed point within said second element, and wherein the second driven conductor element includes a pair of free ends, thereby defining a pair of radiating elements.

2. The antenna assembly of claim 1 wherein the conductive element is defined as ground traces upon a printed wiring board of the wireless device.

3. The antenna assembly of claim 2 wherein the conductive element is substantially planar.

4. The antenna assembly of claim 1 wherein the second elements are substantially parallel to each other.

5. A antenna assembly for a dual-band wireless communications, said antenna assembly comprising:

a antenna ground plane element;

a inverted PIFA-type antenna having a plurality of leg elements, one of the leg elements being conductively connected to the antenna ground plane element, and another of the leg elements defining a first feed point conductively connected to a signal generating component; and a conductive element having a leg element and a first free end, with the leg element being conductively connected to the antenna ground plane element, said first free end being positioned away from the ground plane, with a second feed point being defined between the leg element and the first free end, and said second feed point being conductively connected to the signal generating component, and wherein the conductive element includes a second free end, thereby defining a pair of radiating elements.

6. The antenna assembly of claim 5 wherein the conductive element is generally planar and generally parallel to the ground plane element.

7. The antenna assembly of claim 6 wherein the leg element of the conductive element is substantially perpendicular to the ground plane element.

8. A antenna assembly for a dual-band wireless communications, said antenna assembly comprising:

a antenna ground plane element;

a inverted PIFA-type antenna having a plurality of leg elements, one of the leg elements being conductively connected to the antenna ground plane element, and another of the leg elements defining a first feed point conductively connected to a signal generating component; and a conductive element having a leg element and a free end, with the leg element being conductively connected to the antenna ground plane element, said free end being positioned away from the ground plane, with a second feed point being defined between the leg element and the free end, and said second feed point being conductively connected to the signal generating component, and wherein the ground plane element includes a aperture proximate to the conductive element, with said aperture permitting light to pass through the ground plane element.

9. The antenna assembly of claim 8 wherein an internal light source is selectively operated to illuminate a panel positioned within the aperture.

10. The antenna assembly of claim 9 wherein the light source is activated in response to an external signal.

11. An antenna assembly comprising:

a ground plane element of a wireless communications device;

a PIFA-type antenna element oriented in an inverted manner so that a free end of the PIFA-type antenna element is upwardly extending during intended operation; and a antenna element having a leg element and a planar conductive element having a free end, said leg element being coupled to the ground plane element and said free end being away from the ground plane element, with the antenna element being fed at a feed point positioned between the leg element and the free end of the antenna element, and with the free end of the antenna element being positioned above the PIFA-type antenna element during intended operation.

12. The antenna assembly of claim 11 wherein said leg element is substantially perpendicular to the planar conductive element, and the planar conductive element is substantially parallel to the ground plane element.

13. A wireless communication device comprising:

a ground plane extension element extending away from a ground plane element of the wireless communication device and defining an aperture;

a housing containing the ground plane element and the ground plane extension element; and a translucent panel connected to the housing within the aperture, said panel including indicia visible to a user during normal operation of the device.

14. The wireless communication device of claim 13 wherein the translucent panel is transparent and allows light to pass through the housing.

15. The wireless communication device of claim 13 wherein the translucent panel is backlit by a light source.

16. The wireless communication device of claim 13 wherein the indicia is related to an operational state of the wireless communication device, including ON/OFF state, RING state, ALARM state, and MESSAGE state.

17. The wireless communication device of claim 13 wherein the indicia include advertising.

18. A wireless communication device comprising:

a human hand graspable housing containing signal transmission circuitry and a ground plane element, said ground plane element including an apertured portion allowing light to pass through the ground plane element; and one or more translucent panels positioned at the apertured portion, said one or more panels being lit by a light source from behind or beneath the ground plane element in response to an external signal.

19. The wireless communication device of claim 18 wherein the one or more translucent panels include indicia on a surface thereof, said indicia being visible to a user during normal wireless communication device use.

* * * * *